US006680713B2

(12) United States Patent
Yokoshima et al.

(10) Patent No.: US 6,680,713 B2
(45) Date of Patent: Jan. 20, 2004

(54) ANTENNA AND RADIO WAVE RECEIVING/ TRANSMITTING APPARATUS THEREWITH AND METHOD OF MANUFACTURING THE ANTENNA

(75) Inventors: Takao Yokoshima, Tokyo (JP); Toshiyuki Chiba, Tokyo (JP); Shiro Sugimura, Kanazawa (JP); Hideki Kobayashi, Kanazawa (JP)

(73) Assignees: Mitsubishi Materials Corporation, Tokyo (JP); FEC Co., Ltd., Kanazawa (JP)

( * ) Notice: Subject to any disclaimer, the term of this patent is extended or adjusted under 35 U.S.C. 154(b) by 0 days.

(21) Appl. No.: 09/984,550

(22) Filed: Oct. 30, 2001

(65) Prior Publication Data

US 2002/0118143 A1 Aug. 29, 2002

(30) Foreign Application Priority Data

Oct. 31, 2000 (JP) ..... 2000-333708
Oct. 11, 2001 (JP) ..... 2001-314055

(51) Int. Cl.[7] ..... H01Q 1/36
(52) U.S. Cl. ..... 343/895; 343/700 MS
(58) Field of Search ..... 343/700 MS, 745, 343/749, 860, 895, 702

(56) References Cited

U.S. PATENT DOCUMENTS

| | | | | |
|---|---|---|---|---|
| 2,648,771 A | | 8/1953 | Cork | |
| 4,706,050 A | * | 11/1987 | Andrews | 29/600 |
| 4,827,266 A | * | 5/1989 | Sato et al. | 343/700 MS |
| 5,861,852 A | * | 1/1999 | Asakura et al. | 343/702 |
| 5,870,065 A | * | 2/1999 | Kanba et al. | 343/787 |
| 6,023,251 A | * | 2/2000 | Koo et al. | 343/700 MS |
| 6,034,640 A | * | 3/2000 | Oida et al. | 343/700 MS |
| 6,075,491 A | * | 6/2000 | Dakeya et al. | 343/700 MS |

FOREIGN PATENT DOCUMENTS

| | | |
|---|---|---|
| EP | 0 805 506 | 11/1997 |
| EP | 0 878 864 | 11/1998 |
| EP | 0 896 384 | 2/1999 |
| EP | 1 096 601 | 5/2001 |
| EP | 1 178 561 | 2/2002 |
| JP | 5-15515 | 2/1993 |
| JP | 5-31323 | 4/1993 |
| JP | 7-297627 | 11/1995 |
| JP | 7-321550 | 12/1995 |
| JP | 8-51313 | 2/1996 |
| JP | 8-288739 | 11/1996 |
| JP | 9-98009 | 4/1997 |
| JP | 9-153734 | 6/1997 |
| JP | 9-219610 | 8/1997 |
| JP | 10-13138 | 1/1998 |
| JP | 10-13139 | 1/1998 |
| JP | 10-32413 | 2/1998 |
| JP | 10-32421 | 2/1998 |
| JP | 10-84218 | 3/1998 |
| JP | 10-107537 | 4/1998 |
| JP | 10-209733 | 8/1998 |
| JP | 10-256825 | 9/1998 |
| JP | 11-4113 | 1/1999 |
| JP | 11-55022 | 2/1999 |
| JP | 2001-196831 | 7/2001 |

* cited by examiner

*Primary Examiner*—Tan Ho
(74) *Attorney, Agent, or Firm*—Oblon, Spivak, McClelland, Maier & Neustadt, P.C.

(57) ABSTRACT

A compact antenna enabling to produce high gain is based on an antenna main body is constructed in such a way that a plurality of resonance sections, each having parallel-connected respective inductance sections and capacitance sections, are electrically connected in series, and a frequency adjusting capacitance section is connected electrically in series between a ground section at the ground potential and an exit end of the antenna main body. The resonance sections are constructed so that that the characteristic frequency curves overlap one another at least in the width portion to enable the antenna man body as a whole to resonate at substantially one resonance frequency, which is higher than the normal vibration frequency at which each resonance section resonates.

13 Claims, 9 Drawing Sheets

ANTENNA AND RADIO WAVE RECEIVING/ TRANSMITTING APPARATUS THEREWITH AND METHOD OF MANUFACTURING THE ANTENNA

BACKGROUND OF THE INVENTION

1. Field of the Invention

The present invention relates to an antenna, particularly a compact antenna suitable for inclusion in various devices having capabilities for processing radio signals, including various communication devices that can transmit and receive radio signals.

2. Description of the Related Art

In recent years, there have been increasing uses for antennas that can be used in frequency regions in a range of several hundreds of MHz to several tens of GHz due to increasing demand for various devices having capabilities for transmitting and receiving radio signals, including various communication devices for processing radio signals. Obvious uses for such antennas include mobile communications, next generation traffic management systems, non-contacting type cards for automatic toll collection systems, but in addition, because of the trend toward the use of wireless data handling systems that enable to handle data, without using cumbersome lengthy cables, such as cordless operation of household appliances through the Internet, Intranet radio LAN, Bluetooth and the like, it is anticipated that the use of such antennas will also be widespread in similar fields. Furthermore, such antennas are used in various systems for wireless data handling from various terminals, and the demand is also increasing for applications in telemetering for monitoring information on water pipes, natural gas pipelines and other safety management systems and POS (point-of-sale) terminals in financial systems. Other applications are beginning to emerge over a wide field of commerce including household appliances such as TV that can be made portable by satellite broadcasting as well as vending machines.

To date, such antennas described above used in various devices having capabilities for receiving and transmitting radio signals are mainly monopole antennas attached to the casing of a device. Also known are helical antennas that protrude slightly to the exterior of the casing.

However, in the case of monopole antennas, it is necessary to extend the structure for each use of the device to make the operation cumbersome, and, there is a further problem that the extended portion is susceptible to breaking. Also, in the case of the helical antennas, because a hollow coil that serves as the antenna main body is embedded in a covering material such as polymer resin for protection, the size of device tends to increase if it is mounted on the outside the casing and it is difficult to avoid the problem that the aesthetics suffers. Nevertheless, reducing the size of the antenna leads only to lowering of signal gain, which inevitably leads to increasing the circuit size for processing radio signals to result in significantly higher power consumption and a need for increasing the size of the battery, and ultimately leading back to the problem that the overall size of the device cannot be reduced.

On the other hand, when attempts are made to realize a high gain compact antenna comprised by resonance circuit having an inductance section and a capacitance section to transmit and receive radio waves, it is not sufficient to provide only one resonance section because of insufficient gain produced by such a design, and therefore, it is necessary to combine a plurality of resonance sections to produce one antenna working as a whole. However, if the gain in individual resonance sections is increased, the widths of the characteristic resonance curves become narrow, and a problem arises that it is not possible to resonate all the resonance sections at one frequency in nearly the same phase. Conversely, if the resonance widths are made wider so as to resonate all the resonance section at one frequency in nearly the same phase, it gives rise to a problems that Q values decrease, and consequently, sufficient gain cannot be obtained.

Particularly, when the size of the antenna is made smaller, variations in the inductance and capacitance values tend to increase, causing the individual resonance frequencies to differ to the extent that the widths of the resonance curves hardly superimpose. In practice, it is difficult at the present time to resonate a plurality of resonance sections at one frequency in nearly the same phase while obtaining sufficient gain in individual resonance sections. Even if it is supposed that production is possible with sufficient precision, the productivity inevitably suffers so that there has been a need to develop a new technology to resolve such problems.

SUMMARY OF THE INVENTION

The present invention is provided in view of the background information described above, and an object is to provide a compact antenna that can produce high gain.

The antenna according to the present invention is an antenna comprised by an antenna main body having a plurality of resonance sections connected electrically in series, wherein each resonance section has an inductance section and a capacitance section connected electrically in parallel and resonates at an normal vibration frequency; and the plurality of resonance sections are constructed in such a way that characteristic frequency curves overlap one another at least in the width portion of respective curves so that each resonance section resonates at nearly the same normal vibration frequency, and the antenna main body is constructed so as to have at least one resonance frequency different from the normal vibration frequency of the resonance sections which is produced by coupling of the individual resonance sections.

Furthermore, it is preferable that the resonance frequency is used as a center frequency for transmitting or receiving radio waves for the antenna.

In this case, it is preferable that the center frequency is selected to be higher than the normal vibration frequency.

Especially, it is preferable that the antenna is constructed so that the center frequency is higher than twice the normal vibration frequency.

Therefore, it is preferable that a frequency adjusting capacitance section is connected electrically in series to the antenna main body for adjusting the resonance frequency.

Particularly, it is preferable that the frequency adjusting capacitance section is mounted between the exit end of the antenna main body, which is opposite to the feed end, and a ground section connected to ground potential.

Especially, it is preferable that the ground section is connected electrically from the exit end of the antenna main body to a ground-side of a power line that supplies power to the antenna main body.

According to the present invention, by constructing the antenna in such a way that the antenna main body can resonate at the resonance frequency different from the characteristic individual normal vibration frequencies of the resonance sections, the resonance frequency different from the normal vibration frequency can be selected as the center frequency to be used for radio wave transmission and reception, thereby improving the antenna performance from the viewpoint of releasing the radiative energy from the resonance sections. The reason is that, if the normal vibration frequency itself is chosen as the center frequency, it is thought that a type of energy storage section, in which a current amounting to Q times the current flowing in the antenna main body is flowing, is created in the interior of the resonance sections (acting as a parallel resonance system), to impede the transfer of electromagnetic energy. Therefore, by selecting the center frequency different from the normal vibration frequency, the energy release is facilitated from the capacitance section connected to the inductance section in parallel, thus increasing the antenna gain.

From this viewpoint, the normal vibration frequency at which the resonance section resonates may be higher or lower than the center frequency for reception or transmission of radio waves, but it is preferable that the normal vibration frequency is selected from the low-frequency-side of the center frequency. This is due to the fact that, if the normal vibration frequency is made lower, high values can be chosen for the inductance sections and capacitance sections so that the gain is increased. In other words, if the sizes for the inductance sections and capacitance sections are chosen so as to resonate in the low-frequency-side of the center frequency, it is more desirable for increasing the gain, because the opening area of the coil sections would become relatively larger for short wavelengths of the electromagnetic waves at the center frequency in the high frequency region, for example, and enhanced performance of the antenna may be expected.

For this reason, by choosing a high value of the center frequency, especially if it is higher than twice the normal vibration frequency, phase-matching is further facilitated for the resonance sections, thus enabling to obtain high gain.

Here, it is preferable, in stabilizing the resonance frequency for the overall antenna main body, to connect one end of the frequency adjusting capacitance section in series to the antenna main body and connect other end of the frequency adjusting capacitance section to the ground section at the ground potential. In the first place, the antenna main body cooperates with the ground section and others to resonate as an overall resonating body to generate the resonance frequency different from the normal vibration frequencies of the resonance sections, and therefore, it is possible to adjust the resonance frequency to the center frequency with the frequency adjusting capacitance section. While normal helical antennas, a floating capacitance is generated between the helical body of the helical antenna and the grounded plate, to make the resonance structure vulnerable to adverse effects from the surrounding environment, the present frequency adjusting capacitance section has a specific fixed value, thus enabling to eliminate causes for instability such as adverse effects of surrounding environment.

Also, the inductance section of the antenna main body has coil sections comprised by a conductor formed in a spiral-shape or an angular shape that can be approximated by a spiral.

In this case, it is preferable that the coil axes of the coil sections are aligned substantially on a straight line.

Also, at least one portion of the conductor that circles the coil axes of the conductor sections is contained in a plane inclined at an angle to the coil axes.

Further, the resonance section is constructed by connecting two resonance sections electrically in series.

By adopting such a structure, it is possible to increase the antenna gain. This is due to the fact that, the gain tends to be lower compared with an antenna having two resonance sections, although more than three resonance sections may be connected in series.

Another embodiment of the present invention relates to an antenna comprised by an antenna main body containing a plurality of resonance sections connected electrically in series and receives power from a feed end, wherein each resonance section has an inductance section and a capacitance section connected electrically in parallel and resonates at an normal vibration frequency; and a ground section connected to the ground potential; and the plurality of resonance sections are constructed so that the characteristic frequency curves overlap one another at least partially in the width potion of the respective curves so as to enable the plurality of resonance sections to resonate at nearly the same normal vibration frequency; and the antenna main body is constructed so that the antenna main body has at least one resonance frequency different from the normal vibration frequency produced by coupling of individual resonance sections so that the one resonance frequency is used as a central frequency for transmitting or receiving radio waves for the antenna.

In this case, it is preferable that the frequency adjusting capacitance section is mounted between the exit end, which is opposite to the feed end of the antenna main body, and the ground section.

Especially, it is preferable that the center frequency is higher than the normal vibration frequency, and in particular, the center frequency is higher than twice the normal vibration frequency.

Also, the ground section may be connected electrically to a ground-side of the power line that supplies power to the antenna main body through the feed end of the antenna main body.

Still another embodiment of the present invention relates to an antenna comprised by a plurality of resonance sections having an inductance section and a capacitance section connected electrically in parallel and resonating at a normal vibration frequency; and an antenna main body having the plurality of resonance sections connected electrically in series, each resonance section in the plurality of resonance sections is constructed so that the characteristic frequency curves overlap one another at least partially in the width potion of the respective curves so as to enable each resonance section in the plurality of resonance sections to resonate at frequencies substantially identical to the normal vibration frequency, and the antenna main body has at least one resonance frequency, higher than the normal vibration frequency, as a result of coupling of individual resonance sections.

In the present invention, for example, inductance value of the inductance section that comprises the resonance section is made high and capacitance value of the capacitance section that comprises the resonance section is made low so as to increase the resonance width of the characteristic frequency curves, and therefore, a frequency region included in the resonance width of any resonance section emerges, so that the characteristic frequency curves can overlap at least partially in the width portion of the respective curves. The resonance sections resonate substantially in-phase at one frequency close to the individual normal vibration frequencies within the frequency region where the characteristic frequency curves overlap. Therefore, when these resonance sections are connected electrically in series, the antenna main body responds in such a way that the individual resonance sections couple with one another to produce one resonance frequency that corresponds to the normal vibration frequency, and furthermore, resonance frequencies are generated in a higher frequency region than the normal vibration frequency. It is true that, in order to align the phases of vibration of individual resonance sections, the widths of the normal vibration frequencies are increased and the Q-factors are lowered, nevertheless, in relation to the low-frequency-side, the Q-factor in the high-frequency-side has been increased so that sufficient gain is obtained for the resonance frequencies in the high frequency region.

Accordingly, by constructing the antenna in such a way that the individual resonance sections vibrate in-phase at resonance frequencies on the low-frequency-side of the center frequency, high gain is obtained at the resonance frequencies in the high-frequency-side.

It is preferable that the resonance frequency higher than the normal vibration frequency is used as a center frequency for transmitting and receiving radio waves.

By adopting such a structure, radio waves are transmitted or received using the resonance frequency in the high-frequency-side of the normal vibration frequency of the individual resonance sections. The present antenna thus enables to produce a higher gain than the resonance gain in the low-frequency-side.

The present invention relates also to a radio wave transmission reception apparatus having a transceiver antenna for transmitting or receiving radio waves using an operational center frequency, wherein the transceiver antenna described in any one of the examples described above is used, and the center frequency is used as the operational center frequency.

By adopting such a structure, a compact transceiver antenna of high gain is realized, and the overall size of a radio wave transmitting and receiving apparatus is reduced.

The present invention relates also to an antenna main body receiving power from a feed end through a power line and operates in cooperation with a ground section connected to a ground-side of the power line to transmit or receive radio waves, wherein the antenna main body is comprised by a plurality of resonance sections having an inductance section and a capacitance section connected electrically in parallel and resonating at a normal vibration frequency, and the plurality of resonance sections are connected electrically in series, and each of the plurality of resonance sections is constructed so that the characteristic frequency curves overlap one another at least partially in the width portion of the respective curves so as to enable each resonance section in the plurality of resonance sections to resonate at frequencies substantially identical to the normal vibration frequency, to generate at least one resonance frequency, different from the normal vibration frequency, as a result of coupling of individual resonance sections, and one of the resonance frequencies is used as a center frequency to transmit or receive radio waves.

In this case, it is preferable that the center frequency is a frequency that is higher than the normal vibration frequency.

The present invention relates also to a method for making an antenna by fabricating a plurality of resonance sections, wherein each resonance section resonating at a normal vibration frequency is made by connecting inductance section and capacitance section electrically in parallel so that the characteristic frequency curves overlap one another at least partially in the width portion of the respective curves so that the plurality of resonance sections resonate at nearly the same normal vibration frequency; then, fabricating an antenna main body by connecting the plurality of resonance sections electrically in series so as to produce the antenna main body having at least one resonance frequency of higher frequency than the normal vibration frequency; and adjusting one of the resonance frequencies by connecting a frequency adjusting capacitance section electrically in series to match one of the resonance frequencies, having a higher frequency than the normal vibration frequency, to the operational center frequency for transmitting or receiving radio waves.

In the present invention, in the resonance section fabrication process, inductance value for the inductance section is chosen high, and capacitance value for the capacitance section is chosen low so as to increase the width of the characteristic resonance curves. When the resonance circuit is so designed, there emerges a frequency region which can be included in the width portion of any resonance curves of the resonance sections. In such a circuit, the characteristic frequency curves overlap at least partially in the width portion of the respective curves. Then, the resonance sections resonate substantially in-phase at one frequency close to the individual normal vibration frequencies within the frequency region where the characteristic frequency curves overlap. Therefore, when these resonance sections are connected electrically in series in the antenna main body fabrication process, the antenna main body produces a resonance frequency that corresponds to the normal vibration frequency generated by coupling of the individual resonance sections, and furthermore, resonance frequencies are synthesized in a higher frequency region than the normal vibration frequency. It is true that, in order to align the phases of vibration of individual resonance sections, the widths of the normal vibration frequencies are increased and the Q-factors are lowered, nevertheless, in comparison to the low-frequency-side, the Q-factor of the high-frequency-side has been increased so that sufficient resonance gain is obtained in the high frequency region. Further, in the frequency adjusting process, by connecting a frequency adjusting capacitance section electrically in series to the antenna main body, and adjusting the resonance frequency that has a frequency higher than the normal vibration frequency to match the center frequency, radio waves can be transmitted or received at a higher gain than that possible in the low-frequency-side of the center frequency.

The effects of the present antenna are summarized below.

An antenna according to the present invention is comprised by an antenna main body having a plurality of resonance sections connected electrically in series, wherein each resonance section has an inductance section and a capacitance section connected electrically in parallel; and each resonance section in the plurality of resonance sections is constructed so that characteristic frequency curves overlap one another at least partially in the width portion of respective curves, so that resonance sections resonate at frequencies substantially identical to the normal vibration frequency, and the antenna main body is constructed so as to have at least one resonance frequency that is different from the normal vibration frequency produced as a result of coupling of the resonance sections, thereby enabling to increase the antenna gain.

Also, since one of the resonance frequencies is adjusted to the center frequency for transmitting or receiving radio waves for the antenna, it becomes possible to transmit and receive radio waves with a high gain.

Also, according to the present invention, because the center frequency is higher than the normal vibration frequency, and especially, the center frequency is higher than twice the normal vibration frequency, the antenna gain is increased.

Also, according to the present invention, because the frequency adjusting capacitance section is connected electrically in series to the antenna main body, the antenna can be made to resonate at the resonance frequency different from the normal vibration frequency and the frequency of the synthesized resonance can be adjusted, thereby enabling to increase the antenna gain.

Also, according to the present invention, because the frequency adjusting capacitance section is mounted between the exit end, which is opposite to the feed end of the antenna main body, and the ground section connected to the ground potential, the antenna main body cooperates with the ground section, and the antenna as a whole resonates at a resonance frequency different from the normal vibration frequency, thereby enabling to adjust the overall resonance frequency to a desired center frequency by changing the value of the capacitance of the frequency adjusting capacitance section.

Also, according to the present invention, because the inductance section of the antenna main body has coil sections comprised by a conductor formed in a spiral-shape or an angular shape that can be approximated by a spiral, and the axes of the coil sections are aligned substantially on a straight line, and at least one portion of the conductor that circles the coil axes of the conductor sections is contained in a plane inclined at an angle to the coil axes, the antenna gain is increased.

Also, according to the present invention, because the resonance means is constructed in such a way that two resonance sections are connected electrically in series, antenna gain can be increased.

Also, according to the present invention, because the antenna of the present invention is used as the transceiver antenna in a radio wave transmission and reception apparatus for transmitting or receiving radio waves, the transceiver antenna is compact and produces high gain so that the overall size of the radio wave transmission and reception apparatus can be made small.

Also, according to the present invention, a method is provided for making an antenna comprised by: a resonance section fabrication process for fabricating a plurality of resonance sections in which each resonance section is made by connecting inductance section and capacitance section electrically in parallel so that the plurality of resonance sections resonate at frequencies substantially identical to the normal vibration frequency; followed by an antenna main body fabrication process for connecting the plurality of resonance sections electrically in series so as to produce the antenna main body having at least one resonance frequency higher than the normal vibration frequency; followed by a resonance frequency adjusting process for connecting a frequency adjusting capacitance section electrically in series to the antenna main body and adjusting one of the resonance frequencies having a higher frequency than the normal vibration frequency to match the center frequency for transmitting or receiving radio waves. Therefore, a plurality of resonance sections can be made to vibrate in-phase at a resonance frequency in the low-frequency-side so that high gain can be obtained at a resonance frequency in the high-frequency-side of the normal vibration frequency. Thus, it enables to transmit or receive radio waves at a higher gain than the resonance gain in the low-frequency-side.

DESCRIPTION OF THE PREFERRED EMBODIMENTS

In the following, the antenna according to the present invention will be explained with reference to the drawings.

Embodiment 1

Figure 1:
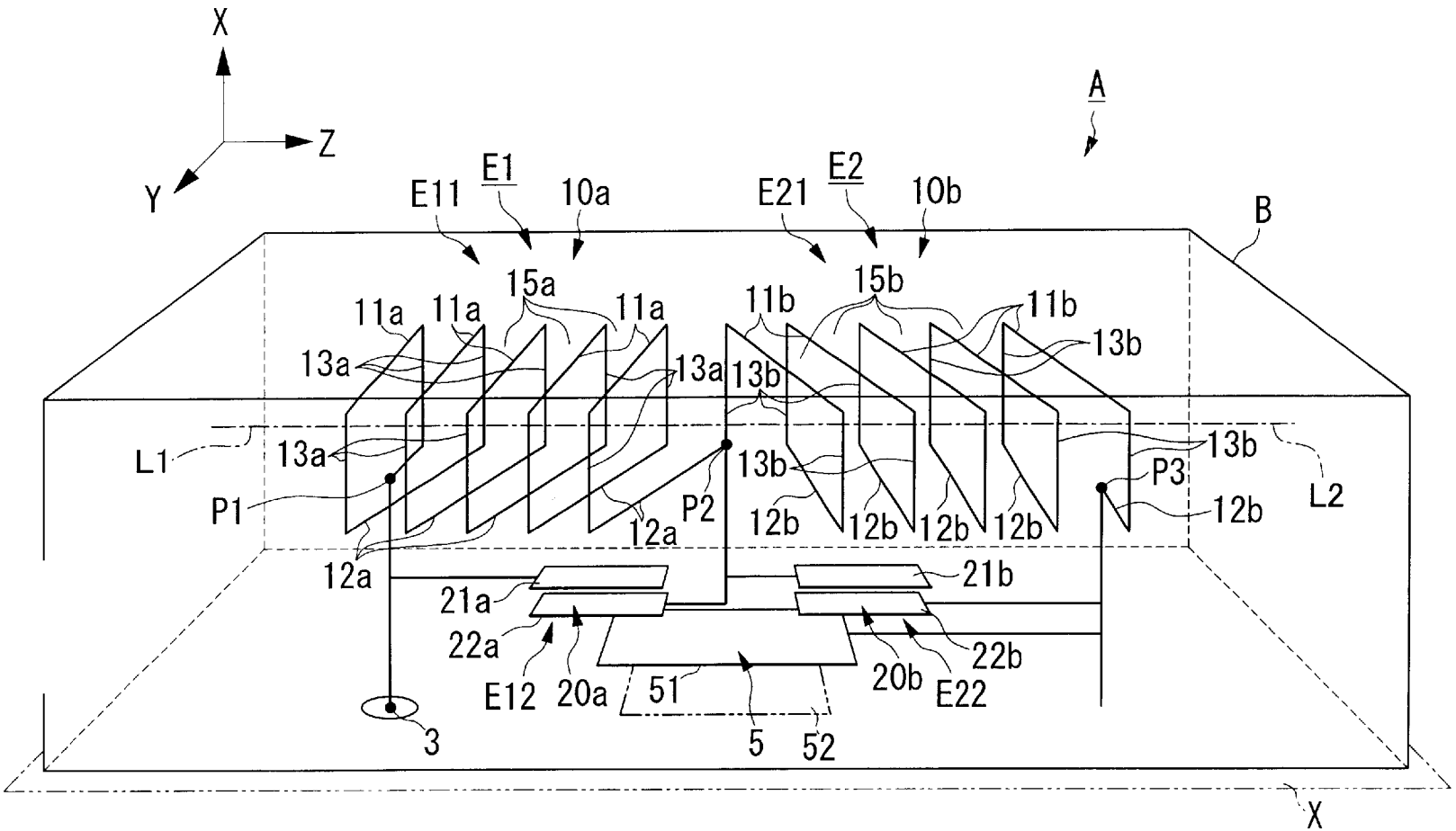
FIG. 1 is a schematic diagram of an embodiment of the antenna of the present invention.
Figure 2:
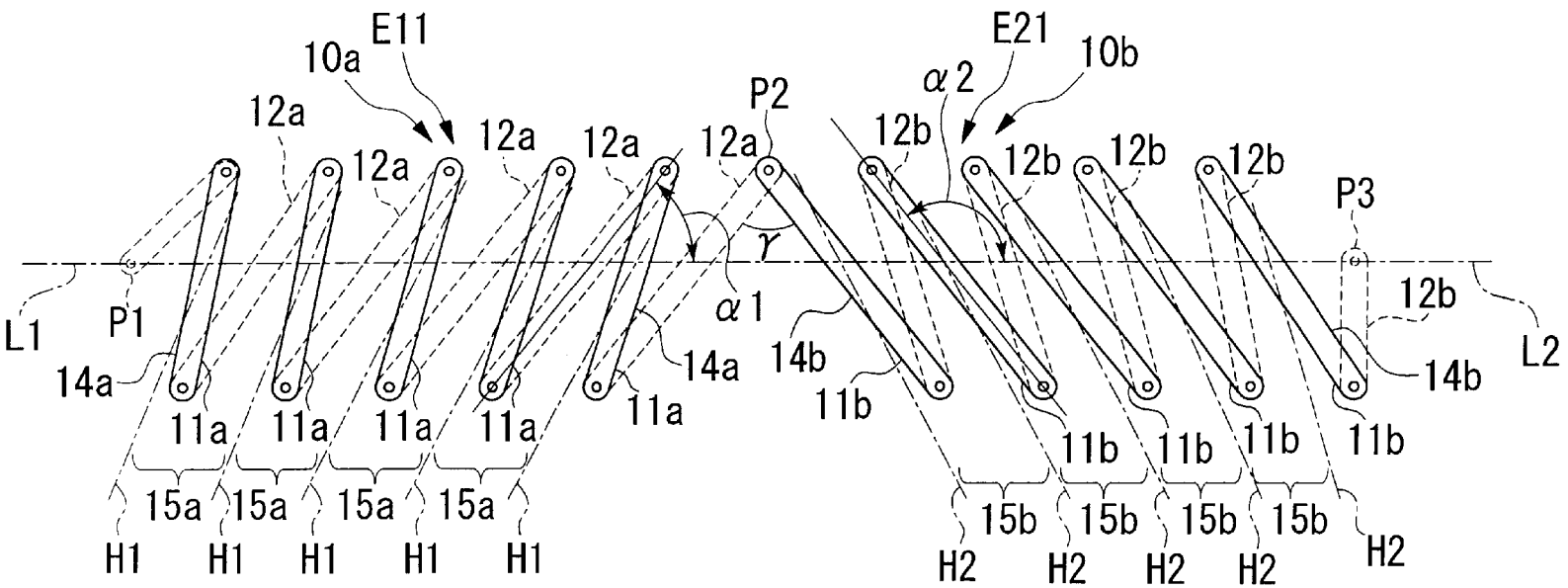
FIG. 2 is a top view of the antenna shown in FIG. 1, and is an enlarged view of the coil section.
Figure 3:
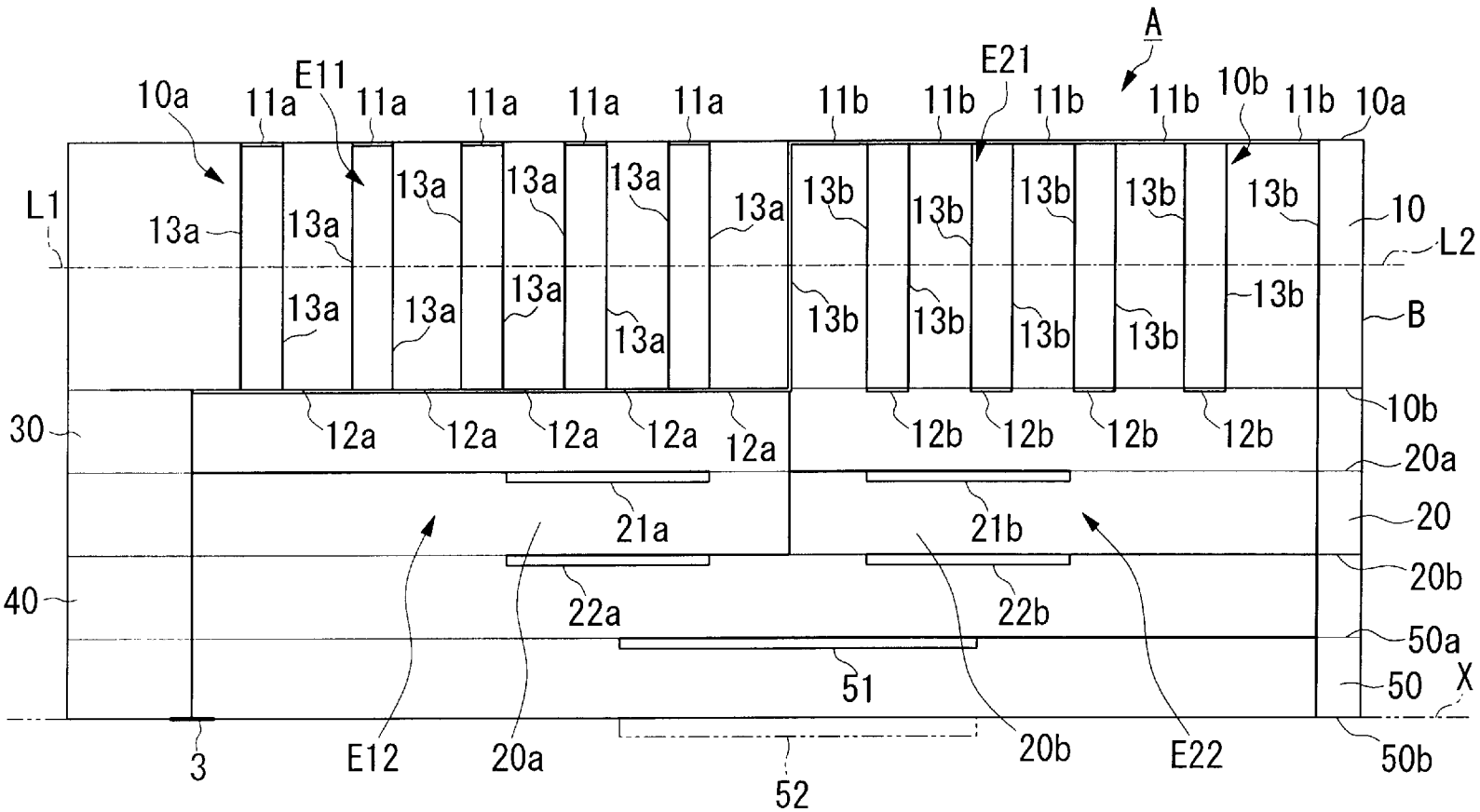
FIG. 3 is a schematic diagram of a lamination structure of the antenna main body.
Figure 4:
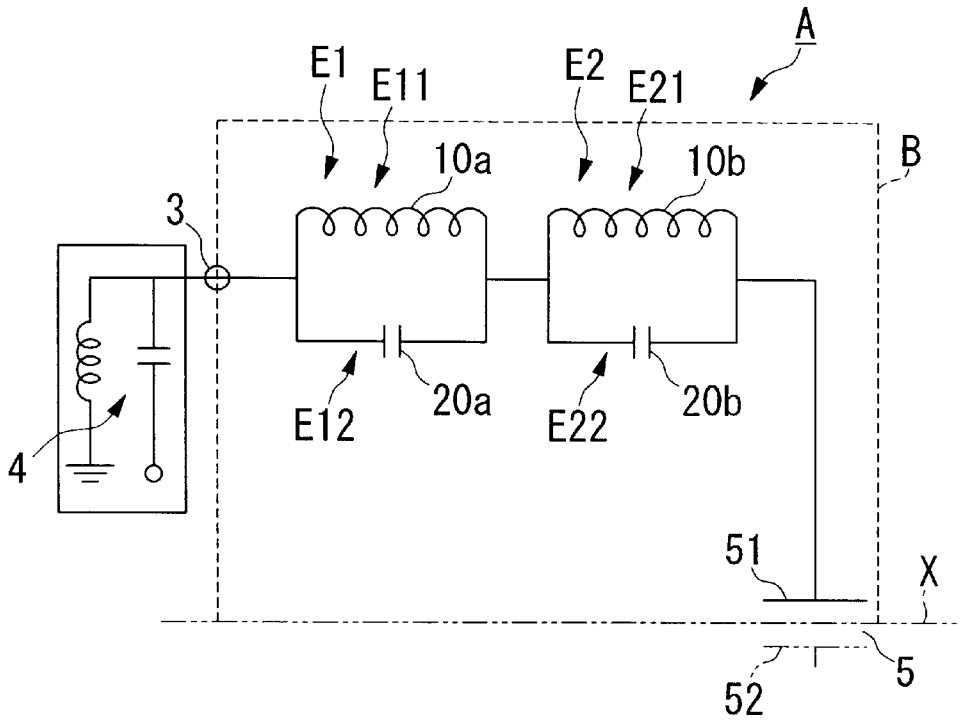
FIG. 4 is an equivalent circuit diagram of the antenna of the present invention.

FIGS. 1~4 show Embodiment 1 of the antenna of the present invention. Referring to the diagrams, antenna A is comprised by: two resonance sections E1, E2 made by the step for fabrication of the resonance sections, in which each resonance section is constructed by connecting inductance sections E11, E21 to respective capacitance sections E12, E22 electrically in parallel; and an antenna main body B made by the step for fabrication of the antenna main body in which the two resonance sections E1, E2 are connected electrically in series. FIG. 4 shows an equivalent circuit of these connection.

One end P1 of the resonance section E1, which is the end not connected to the resonance section E2, is connected to the feed point 3 for supplying power to the resonance sections E1, E2. An impedance matching section 4 is connected externally to the feed point 3 to match the input impedance of the antenna (refer to FIG. 4).

Further, one end P3 of the resonance section E2, which is the end not connected to the resonance section E1, is connected in series to a frequency adjusting capacitance section 5, and other end of this frequency adjusting capacitance section 5 is grounded (refer to FIG. 4).

Inductance section E11, E12 have respective coil sections 10*a*, 10*b*.

The coil section 10*a* is comprised by a conductor body resembling a square shaped spiral circling about a coil axis L1, and, as shown in FIG. 3, this conductor body has conductor patterns 11*a* (first conductor patterns) and conductor patterns 12*a* (second conductor patterns), made of silver and having dimensions of 5 mm length, 0.5 mm width and 0.01 mm thickness, formed respectively on a plane 10*a* (first plane) and a plane 10*b* (second plane) that are oriented parallel to the substrate plate 10 (first substrate plate); and coil conductor sections 13*a* of 1.5 mm length for electrically connecting the conductor patterns 11*a* and 12*a* by means of metal conductor filled in the through-holes punched through the substrate plate 10 in the thickness direction.

The coil section 10*b* is comprised by a conductor body resembling a square shaped spiral circling about a coil axis L2, and this conductor body has conductor patterns 11*b* (first conductor patterns) and conductor patterns 12*b* (second conductor patterns), made of silver and having dimensions of 5 mm length, 0.5 mm width and 0.01 mm thickness, formed respectively on a plane 10*a* (first plane) and a plane 10*b* (second plane) that are oriented parallel to the substrate plate 10 (first substrate plate); and coil conductor sections 13*b* of 1.5 mm length for electrically connecting the conductor patterns 11*a* and 12*a* by means of metal conductor filled in the through-holes punched through the substrate plate 10 in the thickness direction.

The conductor body comprising the coil sections 10*a*, 10*b* is constructed so as to spiral for a number of turns (five turns in this embodiment) in the same direction (clockwise direction in this embodiment) about the coil axes L1, L2.

The coil sections 10*a*, 10*b* are connected so that they are substantially collinear through the junction point P2, and the external dimensions of the antenna A1 are 26 mm in total length and width of about 5 mm. Here, the inductance values of the inductance sections E11, E21 in this embodiment are 69 nH at 1 MHz.

Further, as shown in FIG. 2, viewing from above the coil sections 10*a*, 10*b* and vertically in the direction of the axes L1, L2, the opening sections 14*a* and the conductor patterns 12*a* intersect the coil axis L1 at an angle $\alpha 1$, and the opening sections 14*b* and the conductor patterns 11*b* intersect the coil axis L2 at an angle $\alpha 2$, and these angles $\alpha 1$, $\alpha 2$ are different such that the opening sections 14*a* and opening sections 14*b* intersect each other at an angle $\gamma$, which is close to right angles. The result is that the directions of the magnetic fields in the coil sections 10*a*, 10*b* produced by the currents flowing in the coil sections 10*a*, 10*b* intersect at an angle near the junction point P2. Here, it is preferable that the angle $\gamma$ is in a range of 45–135 degrees, or more preferably 60–120 degrees so as to increase the gain effectively compared with the case of having a same angle for the coil winding angle.

The coil section 10*a* is comprised by a conductor body formed by connecting a plurality of turning sections 15*a* in series, wherein each turning section 15*a* is constructed by a series of conductor patterns that starts from the center of the conductor pattern 11*a* and turns once around the coil axis L1 and stops at the center of the adjacent conductor pattern 11*a* in the linking sequence of conductor pattern 11*a*, coil conductor section 13*a*, conductor pattern 12*a*, coil conductor section 13*a* and conductor pattern 11*a*. The angle $\alpha 1$ relates here to an average angle of intersection of the turning section 15*a* with the coil axis L1. The conductor body is inclined at an angle to the coil axis L1, and further, and is divided by imaginary planes H1, which are at right angles to the paper of FIG. 2, that traverse the center of the conductor pattern 11*a*, and the turning sections 15*a* are formed so that they do not intersect the planes H1 except at the starting point and at the ending point. That is, the turning sections 15*a* are substantially included in the inclined planes H1. Also, because the conductor patterns 11*a*, 12*a* are formed parallel to each other, the turning sections 15*a* are also formed parallel to each other. Because the turning sections 15*a* at both ends of the conductor body form the opening sections 14*a*, the opening sections 14*a* are also included in the planes H1.

Similarly, the coil section 10*b* is comprised by a conductor body formed by connecting a plurality of turning sections 15*b* in series, wherein each turning section 15*b* is constructed by a series of conductor patterns that starts from the center of the conductor pattern 11*b* and turns once around the coil axis L2 and stops at the center of the adjacent conductor pattern 11*b* in the linking sequence of conductor pattern 11*b*, coil conductor section 13*b*, conductor pattern 12*b*, coil conductor section 13*b* and conductor pattern 11*b*. The angle $\alpha 2$ relates here to an average angle of intersection of the turning section 15*b* with the coil axis L2. The conductor body is inclined at an angle to the coil axis L2, and further, and is divided by imaginary planes H2, which are at right angles to the paper of FIG. 2, that traverse the center of the conductor pattern 11*b*, and the turning sections 15*b* are formed so that they do not intersect the planes H2 except at the starting point and at the ending point. That is, the turning sections 15*b* are substantially included in the inclined planes H2. Also, because the conductor patterns 11*b*, 12*b* are formed parallel to each other, the turning sections 15*b* are also formed parallel to each other. Because the turning sections 15*b* at both ends of the conductor body form the opening sections 14*b*, the opening sections 14*b* are also included in the planes H2.

Generally, when the conductor is formed by linking a plurality of portions that circle the coil axis in the direction of the coil axis, and if cylindrical coordinates are used to designate the coil axis as z-axis to describe the position of each section of the conductor, a typical spiral exhibits monotonic changes in the z-coordinate as the angular coordinate $\theta$ is varied. Then, consider a spiral conductor that circles the coil axis over an angular displacement of $\theta$=360 degrees, and one plane intersecting the z-axis at right angles at the starting point and another plane intersecting the z-axis at the ending point of such a spiral, then this spiral does not intersect the planes except at the beginning point and at the ending point of the conductor spiral. If one supposes such a plane for each complete revolution of the conductor spiral, then the conductor is divided by a series of such planes at right angles to the coil axis. When this argument is extended to a general spiral-like conductor or a conductor that can be approximated by a spiral, a group of such planes H1, H2 can be visualized to divide the conductor but the turning portions of the conductor do not intersect the planes except at the beginning points and the ending points of each loop. Then, the portion that circles the coil axis of the conductor can be associated with one of the planes that separates the portion, so that an expression "the portion that circles the coil axis is substantially contained within the imaginary plane that divides the conductor" is used. (herein below imaginary planes that divide the conductor are referred to simply as planes). That is, the opening sections 14*a*, 14*b* formed at the respective coil sections 10*a*, 10*b* are comprised by the portion that circles the coil axis of the conductor, and the opening sections are substantially contained within the planes H1, H2 that circle the coil axis.

The capacitance section E12, E22 have respective condenser sections 20*a*, 20*b*.

The condenser sections 20*a*, 20*b* are comprised by respective conductor patterns 21*a*, 22*b* comprised of silver film of about 0.01 mm thickness and having a roughly square shape formed, respectively, parallel to on one surface 20*a* (third surface) of a substrate plate 20 (second substrate plate), which has the same length and width as the substrate plate 10, and on other surface 20*b* (fourth surface), in such a way that the conductor patterns 21*a*, 21*b* and conductor patterns 22*a*, 22*b* are, respectively, opposite to each other. Then, one conductor pattern 21*a* of the resonance section E1 is connected electrically to the feed point 3 while the other conductor pattern 22*a* is connected electrically to the junction point P2. And, one conductor pattern 21*b* of the resonance section E2 is connected electrically to the junction point P2 while the other conductor pattern 22*b* is connected electrically to the junction point P3. The capacitance values of the capacitance sections E12, E22 in this embodiment are 30 pF at 1 MHz.

Here, the substrate plates 10, 20 are laminated as a unit with an intervening substrate plate 30 (insulation layer), comprised primarily of alumina.

These inductance sections E11, E21 and the capacitance section E12, E22 are connected electrically in parallel to constitute the resonance section E1, E2, which resonate at a common resonance frequency (referred to as the normal vibration frequency herein below) at about 111 MHz. Here, the normal vibration frequency is intentionally set to a value less than half the center frequency used for transmitting or receiving radio waves.

The resonance sections E1, E2 have nearly the same normal vibration frequency, but, in fact, individual normal vibration frequencies are slightly different, due to variations in inductance and capacitance values. However, resonance sections E1, E2 are designed in such a way that, under a condition maintaining the normal vibration frequency constant, the resonance width of the characteristic frequency curve is increased by providing a high value for the inductance and a low value for the capacitance so that there would be a common frequency region, which contains the width portion of the resonance curves of both resonance sections E1 or E2. That is, the resonance sections E1, E2 are constructed such that the characteristic frequency curves overlap one another at least in the width portion of the resonance curve.

Also, at the junction point P3, an electrode 51 (first electrode) is connected electrically, and the electrode 51 is comprised by a silver film of 0.01 mm thickness formed on a surface 50*a* (fifth surface) formed on a substrate plate 50 (frequency adjusting substrate) having an identical width as that of substrate plate 10 and substrate plate 20. And, the substrate plate 50 is positioned so that the electrode 51 faces the inductance sections E11, E21 and the capacitance section E12, E22, and future, it is stacked parallel to the substrate plate 20 so as to clamp the substrate plate 40 comprised primarily of alumina to serve as the insulation layer. As described above, the antenna main body B is laminated as a unified body by laminating the substrate plates 10, 20 having fabricated resonance sections E1, E2 with substrate plates 40, 50.

Antenna A is constructed, in the step for adjustment of the resonance frequency, so that when the antenna main body B is mounted on a printed board X, serving as the substrate plate, the frequency adjusting capacitance section 5 is formed between the electrode 51 and the electrode 52 formed on the printed board X and connected in series to the resonance section E2. That is, the antenna main body B is mounted on the printed board X so that electrode 51 and electrode 52 are disposed to face each other and so that the capacitance value is determined by the areas of the electrodes 51, 52 or the nature of the material and the distance between the electrode plates.

Accordingly, by connecting the frequency adjusting capacitance section 5 to the antenna main body B in series, the resonance frequency of the antenna main body B is adjusted to provide the resonance frequency for the antenna A.

The antenna main body B is constructed in such a way that the resonance sections E1, E2 are connected electrically in series according to the spatial distribution described above to couple with each other, and further, are connected to the ground section (not shown) at the ground potential through the frequency adjusting capacitance section 5, so that the resonance sections E1, E2 can generate the resonance frequency in a frequency region higher than the normal vibration frequency also.

It is to be noted that FIG. 4 shows an equivalent circuit for the impedance matching section 4 for matching the input impedance of antenna A connected to the feed point 3.

The antenna A according to this embodiment is constructed such that two resonance systems, comprised by parallel-connected inductance sections E11, E21 and corresponding capacitance sections E12, E22, are connected in series to transmit receive radio waves at a center frequency of about 450 MHz.

The resonance sections E1, E2 serving as the resonance system are constructed so that each vibrates substantially in-phase at the normal vibration frequency. For this reason, the antenna main body B that connects these components electrically in series also has a resonance frequency that corresponds to the normal vibration frequency, and each resonance section E1, E2 respectively resonates substantially in-phase at this resonance frequency. Accordingly, the overall gain is increased compared with an antenna using a single resonance system.

Because the resonance sections E1, E2 are to be resonated in nearly the same phase at a resonance frequency of the antenna main body B that corresponds to the normal vibration frequency, the values of Q and gain for the resonance sections E1, E2 are basically kept low, so that the antenna gain of the antenna main body B, which is obtained from these individual gains of the resonance sections E1, E2, is also small. However, for the resonance frequency of the antenna main body B as synthesized frequencies that appear on the high-frequency-side of the normal vibration frequency, higher values of Q and gain are obtained compared with those for synthesized frequencies that appear in the low-frequency-side.

The resonance frequency of overall antenna A is changed by adjusting the frequency adjusting capacitance section 5, and the resonance frequency in the high-frequency-side of the antenna main body B that produces a high gain is matched to the center frequency used for transmitting and receiving radio waves, thereby enabling to transmit or receive radio waves at high gain.

Accordingly, by constructing the antenna main body B in such a way that it can resonate at the resonance frequency different from the individual normal vibration frequencies of the resonance sections E1, E2 can be selected as the center frequency for radio wave transmission and reception, thereby improving the antenna performance from the viewpoint of releasing the radiative energy from the resonance sections E1, E2. It is thought that, if the normal vibration frequency itself is chosen as the center frequency, a type of accumulation of energy is created, in the interior of the resonance sections E1, E2 which form a parallel resonance system, that might be analogous to a flow of current equal to Q times the current flowing in the antenna main body B. This type of accumulation of energy will impede the transfer of electromagnetic energy. Therefore, when the center frequency is different from the normal vibration frequency, the energy release process becomes facilitated from the capacitance sections E12, E22 inserted in parallel in the inductance sections E11, E21, thus increasing the antenna gain.

From such a viewpoint, the normal vibration frequency at which the resonance sections E1, E2 resonate may be higher or lower than the center frequency for reception or transmission of radio waves, but it is preferable that the normal vibration frequency is selected from the low-frequency-side. This is due to the fact that, if the normal vibration frequency is low, high values can be chosen for the inductance of the inductance sections E11, E21 and capacitance of the capacitance sections E12, E22, resulting that the gain is increased. In other words, if the sizes of the inductance sections E11, E21 and the capacitance sections E12, E22 are chosen so as to resonate on the low-frequency-side of the center frequency, it is thought that enhanced performance may be expected when the antenna A is used in the high-frequency-side for the short wavelengths electromagnetic waves due to such effects as, for example, the opening area of the coil sections would appear to be relatively large for such short wavelengths.

Here, it is important in stabilizing the resonance frequency of the overall antenna main body B to connect one end of the frequency adjusting capacitance section in series to the antenna main body B, and connect the other end of the frequency adjusting capacitance section to the ground section at the ground potential. By so doing, the antenna main body B cooperates with the ground section, so that it resonates, as an overall resonating body, at a frequency different from the individual normal vibration frequencies of the resonance sections E1, E2, and furthermore, it becomes possible to change to a desired center frequency by adjusting the frequency adjusting capacitance section. In the case of normal helical antennas, a floating capacitance is generated between the helical body of the helical antenna and the grounded plate, to make the structure susceptible to adverse effects of the surrounding environment; however, the present frequency adjusting capacitance section has a specific fixed value so that instability causes such as adverse effects of surrounding environment can be eliminated.

As described above, according to this embodiment, the resonance sections E1, E2 can be made to resonate in-phase at a resonance frequency in the low-frequency-side of the resonance frequency of the antenna main body B, thereby enabling to obtain high gain at a resonance frequency in the high-frequency-side. Further, by using the frequency adjusting capacitance section 5, high gain can be obtained by adjusting the resonance frequency of the antenna main body B in the high-frequency-side to the center frequency for radio wave transmission and reception.

Also, according to this embodiment, because the orientation of the magnetic fields produced by the coil sections 10*a*, 10*b* are different from each other, mutual interference between the resonance sections E1, E2 can be reduced so that the gain is increased. Also, when the opening sections 14*a*, 14*b* are contained within the planes H1, H2 inclined at some angles to the coil axis L1, L2, the directions of the magnetic fields produced by the current flowing in these portions are substantially perpendicular to the planes H1, H2. The magnetic flux that penetrates through the planes H1, H2 is higher than when the planes H1, H2 intersect the coil axes L1, L2 at right angles. Therefore, the inductance values of the coil sections 10*a*, 10*b* are also increased.

Figure 5:
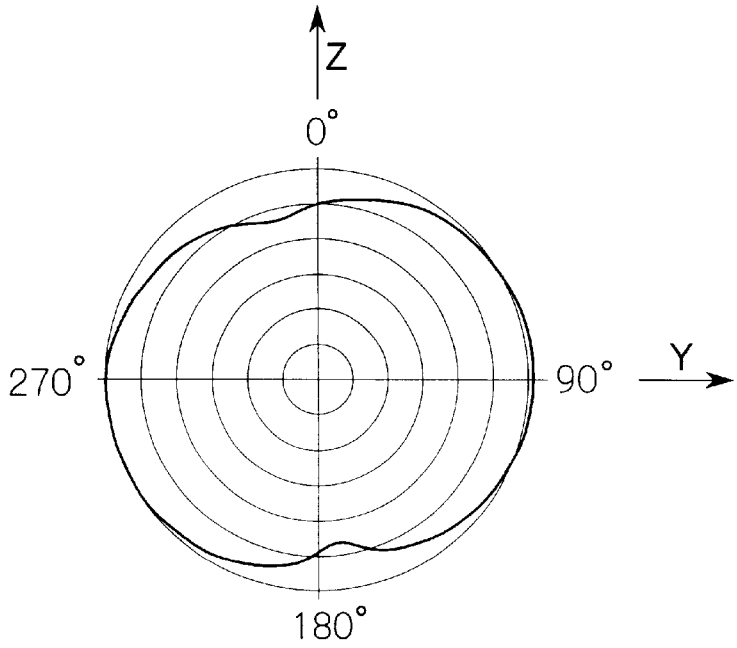
FIG. 5 is a diagram to show the radiation pattern of the antenna of the present invention.

Also, by adopting such a structure, a uniform radiation emission pattern can be obtained to correspond suitably with horizontally and vertically polarized waves. Then, there is no need to intersect the coil axes L1, L2 perpendicularly so that the area required for mounting can be reduced and convenience for mounting can be improved. FIG. 5 shows a radiative power pattern within the y-z plane, and it can be seen that the radiation is basically non-directive. A value of the absolute gain is 1.63 dBi at maximum, and compared with the case of not providing angle of inclination to the conductor, the gain is increased by about 0.5 dBi. In this case, the gain shown in FIG. 5 was measured by preparing a copper-clad glass epoxy substrate plate of 300 mm square having a ground section, removing the copper cladding from a comer to form an insulation region of 50×150 mm, and placing an antenna main body B having external dimensions of 26 mm length and 5 mm width and 2 mm thickness on the insulation region. At this point, on the feed-side, a high frequency input cable was attached through the impedance matching section 4 to give a matching impedance of 50 Ω, and the ground-side of the power input line was connected to the copper on the substrate plate. Also, the frequency adjusting capacitance section 5 was adjusted to 2.2 pF. The result was that the maximum gain 1.63 $dB_i$ was obtained at a center frequency of 478 MHz.

It should be mentioned that it is permissible to provide a frequency adjusting capacitance section 5 as a separate member from the antenna main body B to construct an antenna structure so as to facilitate adjusting and changing the capacitance value. For example, the structure may be such that the frequency adjusting substrate plate 50 is not unified with the substrate plates 10~30, and another condenser is connected electrically in series externally. Further, an antenna module may be constructed such that it is comprised by an antenna main body and an externally-connected condenser section serving the function of the frequency adjusting capacitance section so that the condenser section may be freely detached from the antenna main body to enable easy switching of various condensers having different capacitance values, thereby improving the handling characteristics. Such a construction enables to more flexibly adjust the resonance frequency of the antenna.

Figure 6:
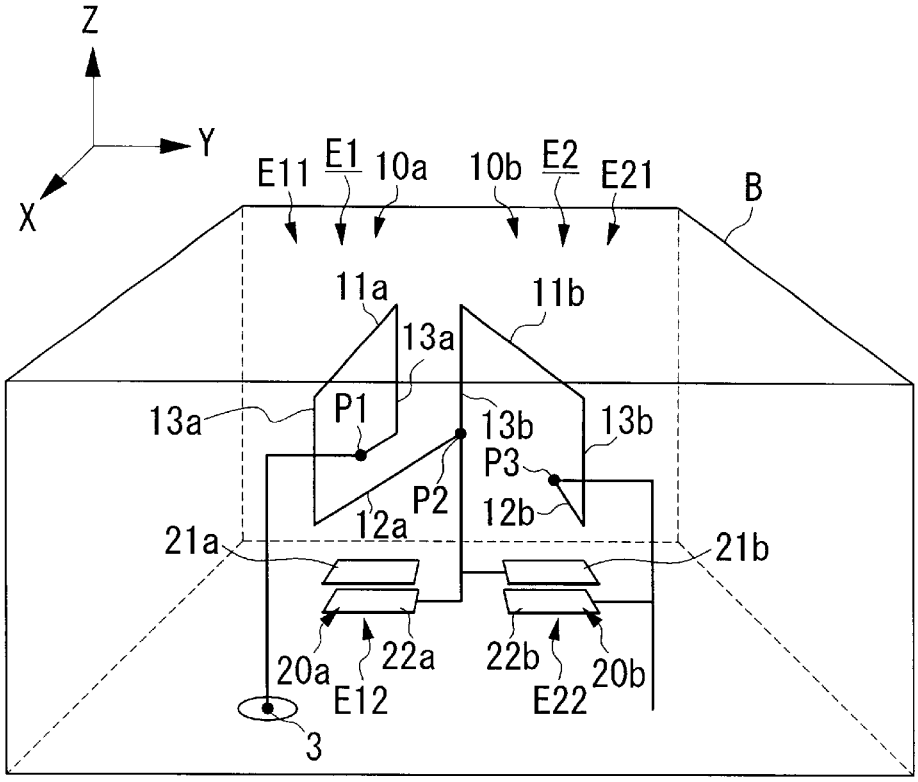
FIG. 6 is a perspective view of a variation of the antenna in Embodiment 1

Further, in the above embodiment, the antenna structure was constructed so that the normal vibration frequency of the resonance sections E1, E2 was about 100 MHz, and they were connected in series as shown in FIGS. 1–4, grounded through the frequency adjusting capacitance section so that the resonance frequency of the antenna as a whole is in the region of 450 MHz, but the structure to obtain high resonance frequencies by combining resonance sections having low frequencies for normal vibration frequencies can also be applied when the antenna system operates in the region of GHz. For example, FIG. 6 shows an antenna main body B of an antenna. This antenna main body B is constructed in such a way to produce a center frequency in the GHz region, and the inductance section E11, E21 are comprised of coil sections 10*a*, 10*b* each having one turn of winding to reduce the inductance value. Such an antenna, at the frequency of 100 MHz, for example, exhibited an inductance value of 4.2 nH each for the inductance sections E11, E21, and exhibited a capacitance value of 16 pF each for the condenser sections 20*a*, 20*b* of the capacitance sections E12, E22, and the external dimensions of the antenna main body B was about 7 mm length, about 3 mm width and about 1 mm thickness. This antenna produced a maximum gain of 0.98 $dB_i$ at a center frequency of 2.356 GHz.

In this case, the gain was measured by using a copper-coated base plate of Teflon of 52×30 mm in size as the substrate plate having a fabricated ground section, and forming an insulation region of 10×30 mm size on an longitudinal end section of the base plate by removing the copper film, and mounting an antenna main body B on the insulation region. Then, a high frequency power cable was connected to the feed-side, and impedance matching was carried out through the impedance matching section to provide 50 Ω impedance, and one end of the end terminal side was connected to the copper film formed on the substrate plate through a 5 mm conductor line that provided a capacitance.

Figure 7:
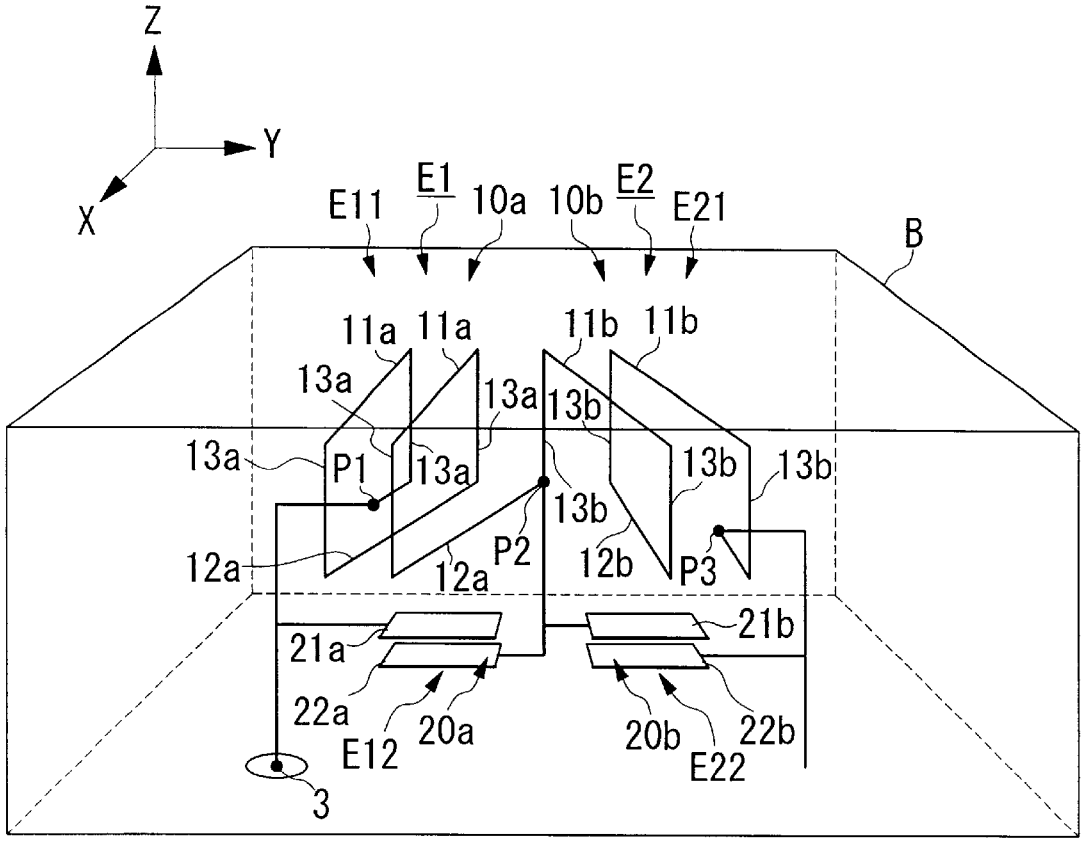
FIG. 7 is a perspective view of another variation of the antenna in Embodiment 1.

Further, as shown in FIG. 7, the inductance sections E11, E21 may be comprised by coil sections 10*a*, 10*b*, each having two turns of winding. Such an antenna, at the frequency of 100 MHz, for example, exhibited an inductance value of 8.0 nH each for the inductance sections E11, E21, and a capacitance value of 10 pF each for the capacitance sections 20*a*, 20*b* of the capacitance section E12, E22, and the external dimensions of the antenna main body B was about 7 mm length, about 3 mm width and about 1 mm thickness. This antenna produced a maximum gain of 0.84 $dB_i$ at a center frequency of 2.346 GHz.

In this case, the gain was determined by using a copper coated base plate of Teflon of 52×30 mm in size as the substrate plate having a fabricated ground section, and forming an insulation region of 10×30 mm size on an longitudinal end section of the base plate by removing the copper film, and mounting an antenna main body B on the insulation region. Then, a high frequency power cable was connected to the feed end side, and impedance matching was carried out through the impedance matching section to provide 50 Ω impedance, and one end of the end terminal side was connected to the copper film formed on the substrate plate through a 5 mm conductor line that provided a capacitance.

The antenna shown in FIGS. 6 and 7 may be provided with a separate frequency adjusting capacitance section for adjusting the center frequency separately from the antenna main body B, and may be connected electrically in series externally. It is possible to shift the center frequency to about 200 MHz if a capacitance C3 having a capacitance value of up to about 0.2 pF is connected.

Here, although not shown in the diagram, as the center frequency used for transmitting and receiving radio waves becomes higher and if the necessary capacitance for generating resonance can be obtained from other portions such as floating ground and the like, insertion of a physical condenser part to form the capacitance section is not always necessary. Therefore, if a design utilizes floating capacitance intentionally to serve as a part of the condenser section of the resonance section, so that, even if the resonance section is apparently comprised only of the inductance section and does not have a physical condenser, it is obvious that such any antenna having such a structure is included within the scope of the present invention.

Embodiment 2

Figure 8:
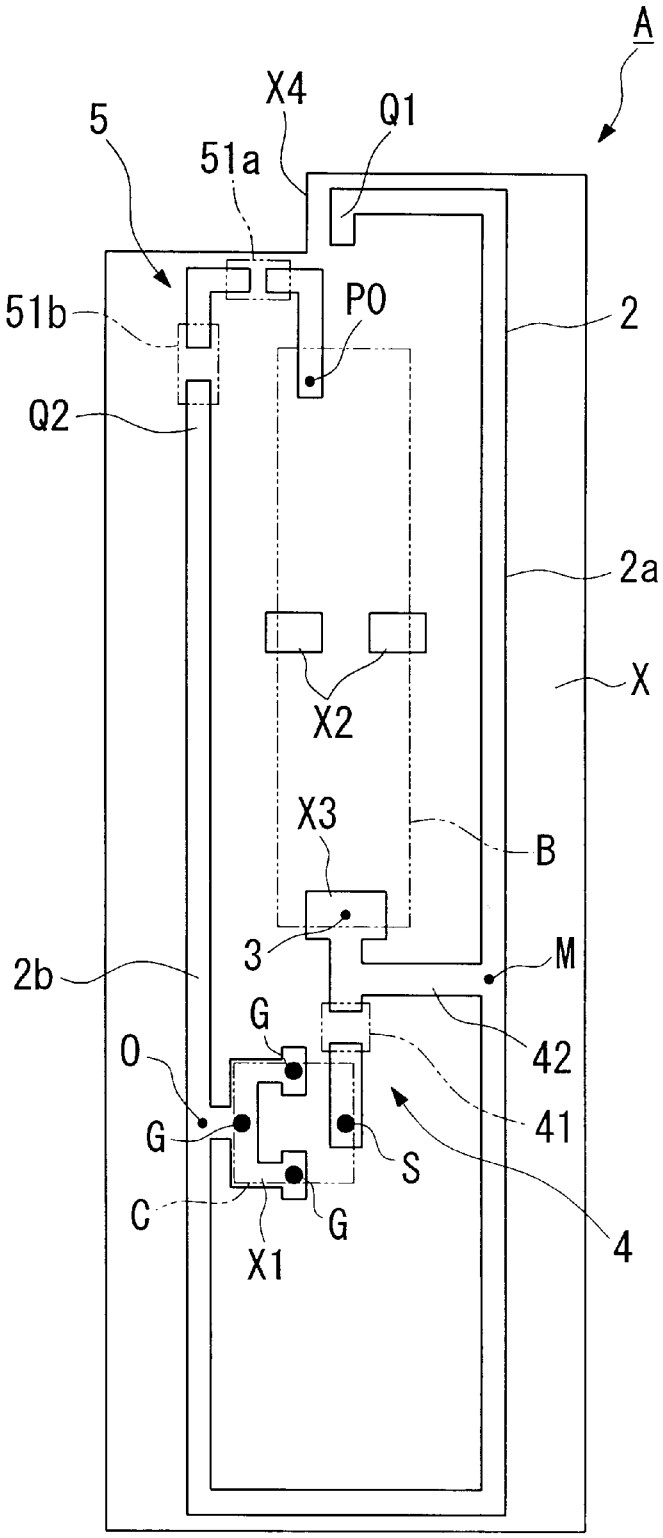
FIG. 8 is a diagram to show a grounding line section formed on a substrate plate of the antenna in another embodiment of the present invention.
Figure 9:
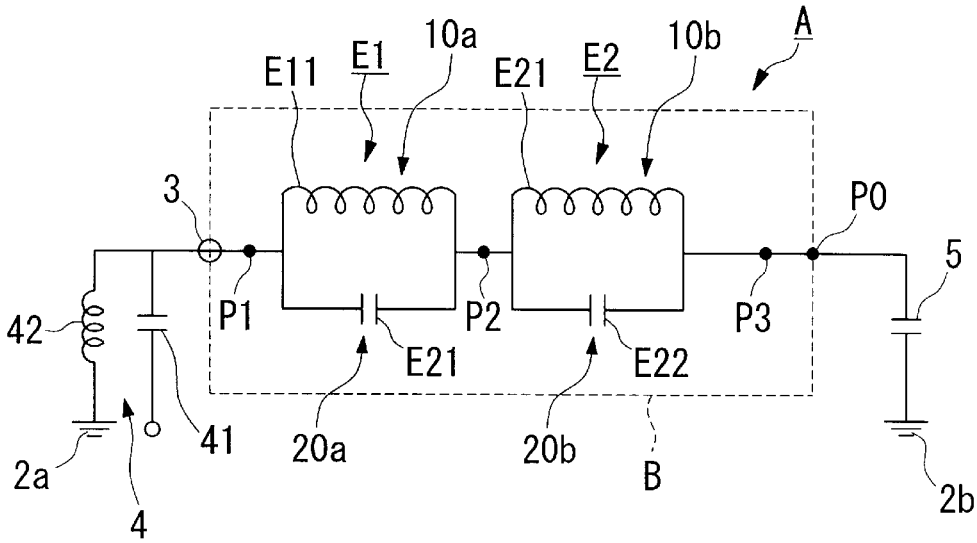
FIG. 9 is a diagram of an equivalent circuit of the antenna shown in FIG. 8.

FIGS. 8–9 show a second embodiment of the antenna of the present invention. In FIG. 8, antenna A is comprised by an antenna main body B and a grounding line section 2 to serve as the ground section, and emits radio waves at a center frequency of about 450 MHz.

The outer conductor on the ground-side of the coaxial cable (power line) for supplying power to the antenna A is connected electrically to a junction point G, while the inner conductor is connected electrically to a junction point S.

Also, between the junction point S and the feed point 3 formed at the feed end of the antenna main body B, an impedance matching section 4 is provided to match the circuit-side impedance value of the radio wave transmission reception system by adjusting the input impedance value of antenna A.

Further, the junction point P0 provided on the exit end opposite to the feed end of the antenna main body B is shorted to the grounding line section 2 by mounting the frequency adjusting capacitance section 5 so that the center frequency of the radio waves emitted from the antenna A can be adjusted.

As shown in the equivalent circuit in FIG. 9, the antenna main body B has two resonance sections E1, E2, which are connected electrically in series. Each of the antenna elements E1, E2 is comprised by inductance sections E11, E21 and respective capacitance sections E21, E22 which are connected in parallel. One end P1 of the resonance section E1 is connected to the feed point 3 for supplying power to the resonance sections E1, E2, while, the exit end P3 of the resonance section E2 is connected to the junction point P0. The structures of the resonance sections E1, E2 are the same as those shown in FIGS. 1–3 so that they are referred to by the same reference numerals and their explanations are omitted.

The grounding line section 2 is comprised of a line conductor pattern of about 1 mm line width formed on the printed board X (substrate plate) including an insulator, and extends from the reference point O (start terminal), which is connected to the coaxial cable C, and forms a loop shape having an opening around the antenna main body B. In this embodiment, which operates at about 450 MHz, the grounding line section 2 and the antenna main body B are separated by at least 10 mm so as not to lower the antenna gain by the effect of the antenna main body B and the grounding line section 2 shorting through a capacitance. The grounding line section 2 includes a terminal section Q1 (a first end terminal) formed by severing a portion of the conductor near the junction point P0 and another terminal section Q2 (a second end terminal), and is essentially comprised by a first grounding section 2*a* that extends from the reference point O to reach the first end terminal Q1, and a second grounding section 2*b* that extends from the reference point O to reach the second end terminal Q2.

The first grounding section 2*a* extends, in the top view, towards a first direction (bottom direction in FIG. 8) along the direction of the length of the antenna main body B starting from the reference point O, and bends 90 degrees to extend in the anti-clockwise direction, as shown in FIG. 8, and again bends 90 degrees to extend in the anti-clockwise direction towards a second direction (top direction in FIG. 8) along the direction of the length of the antenna main body B, and again bends 90 degrees in the anti-clockwise direction, and extends towards the junction point P0 of the antenna main body B. Here, the length from the reference point O to the first end terminal Q1 is chosen to equal one quarter of the wavelength of a radio wave at the center frequency.

The second grounding section 2*b* extends towards the second direction (top direction in FIG. 8) along the direction of the length of the antenna main body B starting from the reference point O, and the length from the reference point O to the second end terminal Q2 is chosen to equal one eighth of the wavelength of the radio wave at the center frequency.

The impedance matching section 4 is comprised by: a matching capacitance section 41 inserted electrically in series between the junction point S connected to the inner conductor of the coaxial cable C and the feed point 3 of the antenna main body B; and a matching inductance section 42 connected electrically to the feed point 3 and the first grounding section 2*a* of the grounding line section 2, so as to provide impedance matching as a whole with an impedance value of 50 Ω for the wave transmission and reception circuit system. FIG. 9 shows an equivalent circuit for these connections.

In this example, the matching capacitance section 41 having a capacitance of 3 pF at 450 MHz is mounted on the printed board X, and the matching inductance section 42 is comprised by a linear conductor pattern formed on the printed board X so as to provide about 5 nH at 450 MHz, and one end is connected to the feed point 3 and other end is connected to a connection site M which is the midpoint between the reference point O of the first grounding section 2*a* and the first end terminal Q1. And, the length of a part of the first grounding section 2*a* between the reference point O and the connection site M is one eighth of the wavelength of the radio wave at the center frequency.

The frequency adjusting capacitance section 5 is comprised by inserting and mounting the capacitors 51*a*, 51*b* electrically between the junction point P0 and the second end terminal Q2 of the second grounding section 2*b* on the printed board X so as to provide capacitance values of 2.5 pF at 450 MHz, 4.7 pF at 300 MHz. Fine adjustments are made possible by having two condensers 51*a*, 51*b*.

On the printed board X, in addition to the conductor patterns described above, there are formed a "L"-shaped coaxial cable connection pattern X1, as shown in the top view in FIG. 8, for connecting the outer conductor of the coaxial cable C, and an antenna attaching pattern X2 for mounting the antenna main body B stably on the printed board X, and furthermore, at the location of the feed point 3, it has a feed pattern X3 of a somewhat wide width. Also, on its outer periphery, for example, a cutaway section X4 is provided so as to fit within the inner attachment space of the device having the transmission and reception capabilities.

According to the above mentioned embodiment, the antenna A can be easily assembled into various devices having radio wave communication capabilities. In this case, the antenna A can be incorporated into the devices without adverse effects of environment in which the antenna is mounted. Moreover, it is possible to carry out impedance matching between the antenna A and the wave transmission reception system without reducing the antenna gain. Adjustment of the center frequency at which radio waves are received and transmitted can be also carried out so as not to lower the antenna gain.

It should be noted that although the center frequency for transmitting and receiving radio waves was fixed at 450 MHz, the center frequency need not be restricted to this value. As the center frequency increases further, the antenna main body as well as the grounding line section can be made smaller.

Also, for the length between the reference point O and the first end terminal Q1, it is permissible to use an integral multiple of one quarter of the wavelength of the radio wave at the center frequency used to transmit receive radio waves from antenna A. In this embodiment, the length of the first grounding section 2*a* of the grounding line section 2 was made equal to one quarter of the wavelength of the radio wave in order to make a smaller antenna A, but this length does not need to be limited to this length such that one half or three quarter of the wavelength of the radio wave may be chosen.

Table 1 shows the results of absolute gain produced by an antenna having an antenna main body, whose external dimensions are 26 mm length, 5 mm width and 2 mm thickness, operated at 450 and 300 MHz by adjusting the length of the first grounding section 2*a* and the second grounding section 2*b* as shown in the table.

TABLE 1

| Frequency (MHz) | 450 | | | | | | | 300 |
|---|---|---|---|---|---|---|---|---|
| Wavelength (cm) | 66 | | | | | | | 100 |
| #1 gnd 2a (cm) | None | 8 | 10 | 16 | 16 | 20 | 33 | 25 |
| #2 gnd 2b (cm) | None | None | 8 | None | 8 | 8 | 8 | 12 |
| Gain ($dB_i$) | −6.86 | −1.61 | −2.55 | 0.94 | 2.07 | −0.98 | 2.20 | 2.55 |

From Table 1, it can be seen that, when operating at 450 MHz and the length of the first grounding section 2*a* is one quarter of the wavelength at 66 cm or the length is one half of the wavelength at 66 cm, the gains are, in fact, increased. Also, when the length of the second grounding section 2*b* is made equal to one eighth of the wavelength 66 cm, the gain is increased even though the length of the first grounding section 2*a* is fixed at one quarter of the wavelength.

It can also be seen that, while maintaining the parameters for the second grounding section 2*b*, when the length of the first grounding section 2*a* is increased by an integral multiple of one quarter of the wavelength, the gain is increased.

It should be noted that, although the absolute value of the gain is not increased very much, the gain does show a peak when the length of the first grounding section 2*a* is one eighth of the wavelength, and the gain is increased compared with the values of the gain obtained when the length of the first grounding section 2*a* is shorter or longer than the value at the peak. Further, the peak value is clearly higher compared with an antenna having no grounding line section.

In the case of operation at 300 MHz, it was found that the gain is increased when the length of the first grounding section 2*a* is one quarter of the wavelength at 100 cm, and the length of the second grounding section 2*b* is one eighth of the wavelength.

Figure 10:
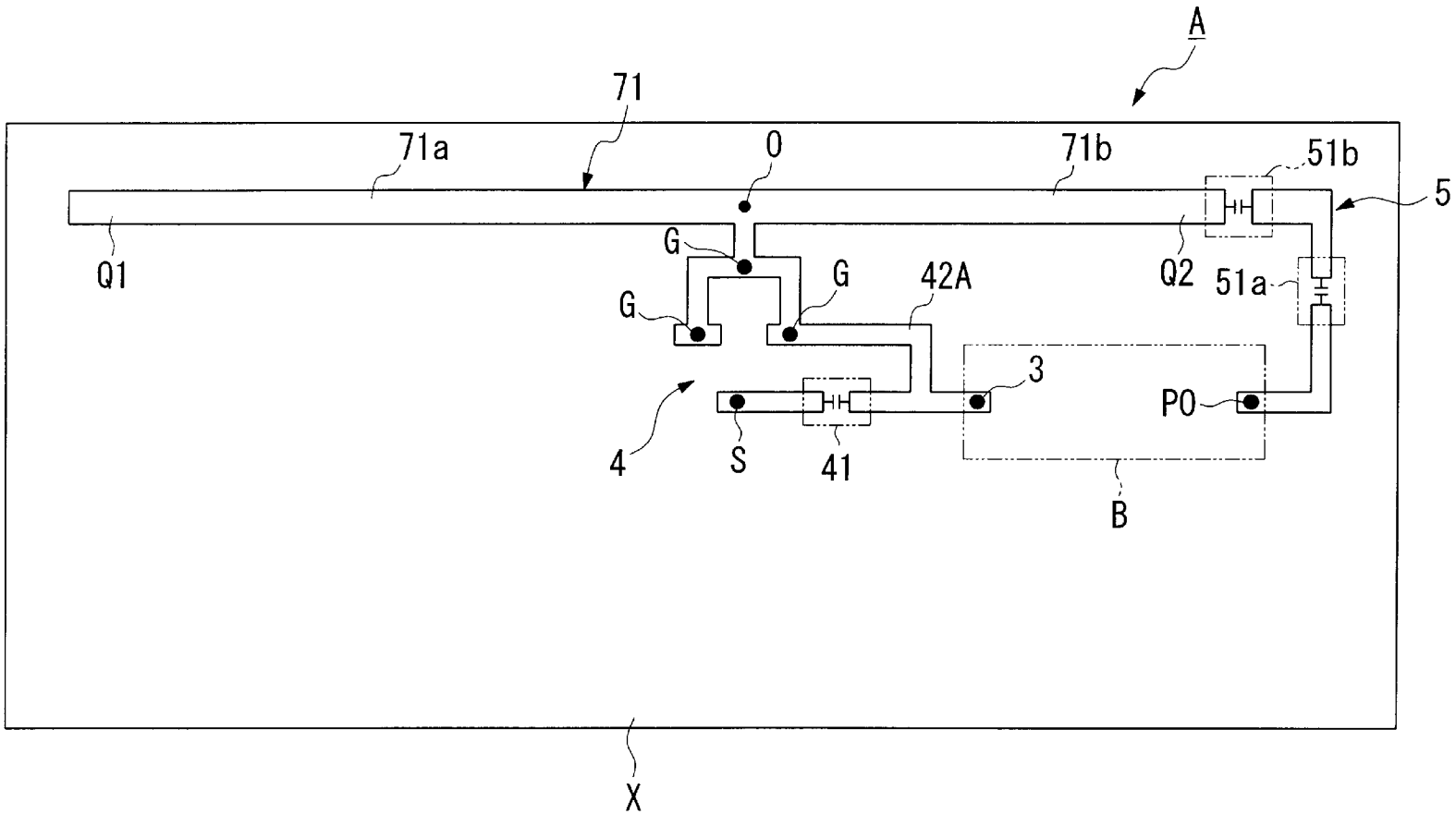
FIG. 10 is a diagram to show a variation of the grounding line section formed on a substrate plate of the antenna in another embodiment of the present invention.

Also, in the embodiment described above, the structure is arranged in such a way that the first and second grounding sections 2*a*, 2*b* surround the antenna main body 1, but, as shown in FIG. 10, it is permissible to arrange a structure so that the first and second grounding sections 71*a*, 71*b* are used to form a grounding section 71 essentially in a linear pattern. That is, in FIG. 10, the first grounding section 71*a* corresponds to the first grounding section 2*a* described above and has a length equal to one quarter of the wavelength of the radio wave at the center frequency, and is formed so as to act as an extension of the second grounding section 71*b*. And, the impedance matching section 42A for impedance matching is formed by a pattern that extends from the feed point 3 of the antenna main body 1 and connects to the junction point G.

The impedance matching section 4 is comprised by: a matching capacitance section 41 inserted electrically in series between the junction point S connected to the inner conductor of the coaxial cable C and the feed point 3 of the antenna main body B; and a matching inductance section 42A connected electrically to the feed point 3 and the first grounding section 71*a* of the grounding line section 2, as a whole, so as to match with an impedance value of 50 Ω of the wave transmission reception circuit system.

Here, the matching capacitance section 41 having a capacitance of 3 pF at 450 MHz is mounted on the printed board X, and the matching inductance section 42A is comprised by a "L"-shaped conductor pattern formed on the printed board X so as to provide about 5 nH at 450 MHz, and one end is connected electrically to the feed point 3 and other end is connected electrically to the junction point G.

Also, the frequency adjusting capacitance section 5 provides capacitance values of 2.5 pF at 450 MHz and 4.7 pF at 300 MHz, and is comprised by inserting and mounting the capacitors 51*a*, 51*b* electrically between the junction point P0 and the second end terminal Q2 of the second grounding section 71*b* on the printed board X. Fine adjustments are made possible by having two capacitors 51*a*, 51*b*.

All other parts that are the same as those shown in FIGS. 1–9 are given the same reference numerals, and their explanations are not necessary.

According to this variation example, because the ground plate (grounding line section) is made in a straight line as a grounding wire, it can be made to function effectively as the radiating element, enabling the antenna characteristics (gain and directivity) to be further improved. Table 2 shows the results of absolute gain produced by an antenna A, shown in FIG. 7, having an antenna main body whose external dimensions are 26 mm length, 5 mm width and 2 mm thickness, operated at 450 and 300 MHz by adjusting the length of the first grounding section 71*a* and the second grounding section 71*b* as indicated in the table.

TABLE 2

| Frequency (MHz) | 450 | | | | | | | 300 |
|---|---|---|---|---|---|---|---|---|
| Wavelength (cm) | 66 | | | | | | | 100 |
| #1 gnd 71a (cm) | None | 8 | 10 | 16 | 16 | 20 | 33 | 25 |
| #2 gnd 71b (cm) | None | None | 8 | None | 8 | 8 | 8 | 12 |
| Gain ($dB_i$) | −6.86 | −1.52 | −2.45 | 1.11 | 2.32 | −0.55 | 2.47 | 2.79 |

From Table 2, it can be seen that, when operating at 450 MHz and the length of the first grounding section 71*a* is one quarter of the wavelength at 66 cm or the length is one half of the wavelength at 66 cm, the gains are, in fact, increased. Also, when the length of the second grounding section 71*b* is made equal to one eighth of the wavelength at 66 cm, the gain is increased even though the length of the first grounding section 71*a* is fixed at one quarter of the wavelength.

It can also be seen that, while maintaining the parameters for the second grounding section 71*b*, when the length of the first grounding section 71*a* is increased by an integral multiple of one quarter of the wavelength, the gain is increased.

It should be noted that, although the absolute value of the gain is not increased very much, the gain does show a peak when the length of the first grounding section 71*a* is one eighth of the wavelength, and the gain is increased compared with the values of the gain obtained when the length of the first grounding section 71*a* is shorter or longer than the value at the peak. Further, the peak value is clearly higher compared with an antenna having no grounding line section.

In the case of operation at 300 MHz, it was found that the gain is increased when the length of the first grounding section 71*a* is one quarter of the wavelength at 100 cm, and the length of the second grounding section 71*b* is one eighth of the wavelength.

Also, it can be seen that, compared with the case of having the grounding line section surrounding the antenna main body, the gain of the present antenna is increased. However, when the grounding line section is arranged to surround the antenna main body, the overall size of the antenna can be made smaller, but, as can be seen by comparing the results shown in Tables 1 and 2, the values of antenna gain shown in Table 1 are not greatly lower than those shown in Table 2. Accordingly, the present invention enables the user to choose either to aim for high gain by selecting the shapes of the grounding line section as shown in FIG. 10, or to aim for a compact size of the overall antenna as shown in FIG. 8.

It should be noted that the shapes of the grounding line section are not limited to those shown in FIG. 8 or 10, and it is obvious that other shapes can be chosen to suit the casing of a device that contains the present antenna.

In the second embodiment described above, as shown in FIGS. 8~10, the structure is such that the frequency adjusting capacitance section 5 is inserted between the junction point P0 and the second end terminal Q2 of the second grounding section 2*b*, and is connected to the exterior of the antenna main body B, however, it is permissible to arrange a structure such that the frequency adjusting capacitance section 5 is provided inside the antenna main body B, and the second end terminal Q2 of the second grounding section 2*b* is connected directly to the junction point P0.

Furthermore, as in Embodiment 1 described above, it is permissible to construct a structure such that the second end terminal Q2 is connected directly to the junction point P0, and form a first electrode of the frequency adjusting capacitance section 5 on the junction point P0, while, on the antenna main body B, a second electrode is provided to form the frequency adjusting capacitance section 5 in cooperation with the first electrode so that when antenna main body B is mounted on the printed board X, the first and second electrodes form the frequency adjusting capacitance section 5. In this case, by adjusting the distance and position and the like of the antenna main body B relative to the printed board X, capacitance values of the frequency adjusting capacitance section 5 can be adjusted, in other words, the center frequency used for transmission or reception of radio waves can be adjusted flexibly.

As described above, such an antenna A is ideally suited for use in transmitting or receiving radio waves for various devices having capabilities for transmitting and receiving radio signals at a certain operational center frequency, including various communication devices for processing radio signals. This is because the antenna A enables the center frequency of the antenna A to be adjusted to the operational center frequency of the radio wave transmission and reception devices, and the antenna as a whole is compact and produces high gain, the radio wave transmission and reception devices can also be made smaller for portability Here, embodiments explained above relate to those which are considered most practical and preferred examples of the present antenna; however, the present invention is not limited to those embodiments described, and includes any and all variations of the basic invention that are obvious to those skilled in the art.

In particular, the number of resonance sections need not be limited to two, such that more than three sections may be provided, although the resonance frequency of the antenna as a whole becomes susceptible to generating frequencies in regions other than the operational center frequency, so that the overall gain tends to decrease.

What is claimed is:

1. An antenna comprising:

an antenna main body having a plurality of resonance sections connected electrically in series, each of the plurality of resonance sections having an inductance section and a capacitance section connected electrically in parallel and being configured to resonate at a normal vibration frequency, wherein the plurality of resonance sections have characteristic frequency curves that overlap one another at least in a width portion of respective resonance curves so that each of the plurality of resonance sections resonates at nearly a same normal vibration frequency, and wherein the antenna main body has at least one resonance frequency different from the normal vibration frequency of the plurality of resonance sections, said at least one resonance frequency being produced by coupling individual resonance sections.

2. The antenna according to claim 1, wherein the at least one resonance frequency of the antenna main body is used as a center frequency for transmitting or receiving radio waves for the antenna.

3. An antenna comprising:

an antenna main body having a plurality of resonance sections connected electrically in series, each of the plurality of resonance sections having an inductance section and a capacitance section connected electrically in parallel and being configured to resonate at a normal vibration frequency, wherein the plurality of resonance sections have characteristic frequency curves that overlap one another at least in a width portion of respective resonance curves so that each of the plurality of resonance sections resonates at nearly a same normal vibration frequency, and wherein the antenna main body has at least one resonance frequency different from the normal vibration frequency of the plurality of resonance sections, said at least one resonance frequency being produced by coupling individual resonance sections, wherein the at least one resonance frequency of the antenna main body is used as a center frequency for transmitting or receiving radio waves for the antenna, and wherein the center frequency is selected to be higher than the normal vibration frequency.

4. An antenna according to claim 3, wherein the center frequency is higher than twice the normal vibration frequency.

5. An antenna comprising:

an antenna main body having a plurality of resonance sections connected electrically in series, each of the plurality of resonance sections having an inductance section and a capacitance section connected electrically in parallel and being configured to resonate at a normal vibration frequency, said antenna main body having at least one resonance frequency different from the normal vibration frequency of the plurality of resonance sections, said at least one resonance frequency of the antenna main body being produced by coupling individual resonance sections; and a frequency adjusting capacitance section connected electrically in series to the antenna main body and configured to adjust the at least one resonance frequency of the antenna main body, wherein the plurality of resonance sections have characteristic frequency curves that overlap one another at least in a width portion of respective resonance curves so that each of the plurality of resonance sections resonates at nearly a same normal vibration frequency.

6. An antenna according to claim 5, wherein the frequency adjusting capacitance section is mounted between an exit end, which is opposite to a feed end of the antenna main body, and a ground section connected to ground potential.

7. An antenna according to claim 6, wherein the inductance section of the antenna main body has coil sections including a conductor formed in a spiral-shape or an angular shape that can be approximated by a spiral.

8. An antenna according to claim 7, wherein axes of the coil sections are aligned substantially on a straight line.

9. An antenna according to claim 8, wherein at least one portion of the conductor that circles the coil axes of the conductor sections is contained in a plane inclined at an angle to the coil axes.

10. An antenna according to claim 6, wherein the plurality of resonance sections connected electrically in series are two resonance sections connected electrically in series.

11. An antenna comprising:

an antenna main body having a plurality of resonance sections connected electrically in series, each of the plurality of resonance sections having an inductance section and a capacitance section connected electrically in parallel and being configured to resonate at a normal vibration frequency, said antenna main body having at least one resonance frequency different from the normal vibration frequency of the plurality of resonance sections, said at least one resonance frequency of the antenna main body being produced by coupling individual resonance sections; and a frequency adjusting capacitance section connected electrically in series to the antenna main body and configured to adjust the at least one resonance frequency of the antenna main body, wherein the plurality of resonance sections have characteristic frequency curves that overlap one another at least in a width portion of respective resonance curves so that each of the plurality of resonance sections resonates at nearly the same normal vibration frequency, wherein the at least one resonance frequency is used as a center frequency for transmitting or receiving radio waves for the antenna, and wherein the center frequency is selected to be higher than the normal vibration frequency.

12. A radio wave transmission/reception apparatus comprising:

a transceiver antenna configured to transmit or receive radio waves using an operational center frequency, wherein the transceiver antenna includes an antenna main body having a plurality of resonance sections connected electrically in series, each of the plurality of resonance sections having an inductance section and a capacitance section connected electrically in parallel and being configured to resonate at a normal vibration frequency, wherein the plurality of resonance sections have characteristic frequency curves that overlap one another at least in a width portion of respective resonance curves so that each of the plurality of resonance sections resonates at nearly the same normal vibration frequency, wherein the antenna main body has at least one resonance frequency different from the normal vibration frequency of the plurality of resonance sections, said at least one resonance frequency of the antenna main body being produced by coupling individual resonance sections, wherein the at least one resonance frequency is used as a center frequency for transmitting or receiving radio waves for the antenna, and wherein the center frequency is used as an operational center frequency of the radio wave transmission/reception apparatus.

13. A method for making an antenna comprising:

fabricating a plurality of resonance sections in which each resonance section is made to resonate at a normal vibration frequency by connecting an inductance section and a capacitance section electrically in parallel so that characteristic frequency curves of the plurality of resonance sections overlap one another at least partially in a width portion of respective curves so as to enable each of the plurality of resonance sections to resonate at nearly a same normal vibration frequency;

fabricating an antenna main body by connecting the plurality of resonance sections electrically in series so as to produce the antenna main body having at least one resonance frequency higher than the normal vibration frequency; and adjusting the at least one resonance frequency by connecting a frequency adjusting capacitance section electrically in series to the antenna main body to match the at least one resonance frequency having the higher frequency than the normal vibration frequency to a center frequency for transmitting or receiving radio waves.

* * * * *